United States Patent [19]

Pierik

[11] 4,003,133

[45] Jan. 18, 1977

[54] METHOD FOR THE ALIGNMENT OF MACHINE PARTS

[75] Inventor: Johannes A. F. Pierik, Santpoort, Netherlands

[73] Assignee: Papierfabrieken Van Gelder Zonen N.V., Amsterdam, Netherlands

[22] Filed: May 21, 1974

[21] Appl. No.: 471,971

[30] Foreign Application Priority Data

May 21, 1973 Netherlands ..... 7307071

[52] U.S. Cl. ..... 33/228; 33/182; 33/286

[51] Int. Cl.[2] ..... G01B 11/27

[58] Field of Search ..... 33/286, 289, 182, 228

[56] References Cited

UNITED STATES PATENTS

| | | | |
|---|---|---|---|
| 2,570,275 | 10/1951 | Reading | 33/286 X |
| 3,482,317 | 12/1969 | Truax | 33/289 |
| 3,604,121 | 9/1971 | Hull | 33/182 |
| 3,704,522 | 12/1972 | Blubaugh et al. | 33/286 |
| 3,752,588 | 8/1973 | Chapman | 33/289 |
| 3,782,158 | 1/1974 | MacPherson | 33/286 |

*Primary Examiner*—William D. Martin, Jr.
*Attorney, Agent, or Firm*—Stevens, Davis, Miller & Mosher

[57] ABSTRACT

A method for optically aigning a machine part which should have its center line perpendicular to the vertical plane of a reference. The deviation in the horizontal and in the vertical plane between the actual position and the desired position of the part is numerically determined through the use of a theodolite. For determining the deviation in the horizontal plane two reference marks are provided entirely outside the machine at a distance as far as possible from each other. The distance between the two reference marks determines both a base line running parallel to the longitudinal center line of the machine and the position of the vertical plane of reference.

9 Claims, 3 Drawing Figures

METHOD FOR THE ALIGNMENT OF MACHINE PARTS

The invention refers to a method for the alignment in an optical manner of machine parts, in which the center line of each part to be aligned should be perpendicular to a vertical plane of reference, in which, with the help of optical means, for each part to be aligned, the deviation in the horizontal and in the vertical plane between the actual position and the desired position is numerically determined, and in which for the determination of the deviation in the horizontal plane two reference marks are provided entirely outside the machine and at a distance as far as possible from each other, which determine both a base — usually running parallel to the longitudinal center line of the machine — and at the same time the position of the vertical plane of reference. Furthermore the invention relates to apparatus to be used in the mentioned method.

In industry machines are often used in which various parts, sometimes situated at a considerable distance of each other, have to be aligned precisely with respect to each other, i.e., these parts have to be positioned in such a way that their center lines are exactly parallel. In particular it is important for machines which operate with rolls, that all these rolls are positioned precisely parallel to each other, because if these rolls are not positioned exactly in parallel positions, the product web or the like which runs over the rolls may run to one side or askew and/or may tear, which not only causes a loss of the product but also a loss of working time, because frequent shutting off, introducing the strip again and putting the machine into operation will be necessary. For instance these problems may occur in roll lines for the production of paper, textile or metal rolled products and in rotary presses.

Since it is possible that during the operation of such machines the position of the rolls and other parts changes, it is of great importance that the alignment of the rolls and other parts not only is performed during the building, assembling and positioning of the machine, but that this can also be repeated during the — usually periodical — maintenance. Since it is desired to limit the time necessary for maintenance to a minimum and consequently the time during which the machine is not in working order, it is essential to have at one's disposal a method for the alignment of machine parts, which does not take up much time, yet is accurate and which can be performed with simple and not expensive apparatus. Further it is desired that this alignment of machine parts hinder the other maintenance operations as little as possible and that it can be performed by a small number of operators, who do not have to be highly skilled. If highly skilled operators would be necessary, this could mean a heavy financial burden to the company, because such a team would not have a full day's work performing alignments, for normally these activities are only performed periodically during maintenance.

In the conventional method for the alignment of machine parts a measuring tape, a plummet, a water level and trimmelbars are used. However, this method involves many difficulties. The deviations can usually not be expressed in figures. There is no fixed measuring base with respect to which the deviation of the various machine parts can be ascertained. The errors made at a certain measurement are added to the errors of the next measurement. The final measurement cannot be checked by relating it to the measurement at the start. The method takes up much time and requires much personnel. Finally, the measurements to be performed at the machine itself could hinder the progress of the other maintenance work or the measurements can be delayed by the maintenance work.

A better method for the alignment of machine parts is an optical working method, in which methods and apparatus are used which are known in land surveying, i.e., the water level and the theodolite.

Rolls in a rolling line or rollers for guiding and treating webs of material should for instance be placed in such a manner, that their center lines are not only parallel, but also horizontal, thus being perpendicular to a vertical plane of reference that usually runs through the longitudinal center line of the rolling line. During the optical alignment the deviation of each roll is measured which shows the direction of the center line of the roll with respect to the desired direction, both in the horizontal and in the vertical plane.

In order to determine the deviation of the position of the center lines of the rolls in the horizontal plane, preferably during the construction and/or positioning of the machine, a base parallel to the center line of the rolling line is established, which is situated entirely beyond the rolling line. This base is a line parallel to the longitudinal center line of the machine, and is determined by two reference marks which for instance are included in two small metal plates, preferably of stainless steel, which are secured in the floor of the machine hall. In order to obtain a measuring exactness as high as possible, the distance between these reference marks should be as large as possible. Usually the distance between these two reference marks will be approximately equal to the total length of the rolling line, for instance 100 to 200 meters.

According to the known optical method for alignment, a theodolite is now placed exactly vertically over one of the two reference marks and then pointed towards a visible mark, which is put vertically over the other reference mark. After this the theodolite is fixed in such a way that the viewer can only turn in a vertical plane that runs through the base. Thereafter a small plate with a line on it, is placed opposite each of the rolls to be aligned on the floor, and with the help of the theodolite these plates are shifted in such a way, or the lines on these plates are drawn in such a way, that all these lines will run in the vertical plane of reference through the base.

After finishing this first phase, which is very time consuming, the theodolite is removed and successively placed perpendicularly over the lines on each of the plates and pointed towards the beacon which is over one of the reference marks. The theodolite is then again fixed and thereafter the apparatus is adjusted in such a way that the viewer can turn in a vertical plane perpendicular to the base. Next, for each roll the distances are determined between this vertical plane perpendicular to the base and the two ends of the rolls. If these distances are equal, the direction of the center line of the roll as projected on a horizontal plane is the correct one.

Thereafter it should be examined whether the center lines of the rolls run horizontally. With the help of a water level, which is placed in such a way that the viewer can turn in a horizontal plane, the difference in height is determined between the two ends of the roll.

If this difference in height amounts to zero, the center line of the roll runs horizontally.

It is obvious that although the optical method for the alignment of machine parts as described above offers great advantages over the non-optical method described before, this optical method is still very time consuming and moreover can only be performed by highly skilled and specialized operators. Further it is a drawback that almost during the entire measuring time the space over the base must be kept free, because the position of the small plates with a line on it may not be disturbed and one should also be able to point the viewer from the place of one of these plates towards the beacon.

It is now considered that it is not essential to first determine the vertical plane of reference that runs through the base, but that one can take as well as a starting point any vertical plane of reference which runs parallel with the first mentioned plane. Such a plane of reference is determined by a line of which the projection in the horizontal plane runs parallel to or coincides with the base and a vertical line which crosses this line.

Further it is considered that, if a reflecting surface, of which each section with a horizontal plane is a straight line, is placed in such a way, that each such section intersects or crosses the base perpendicularly, and if thereafter a viewer is placed in front of this reflecting device in such a way that the center line of the viewer is pointed towards one point of the vertical crosswire and preferably towards the center of the image of this viewer, the center line of the viewer and a vertical line which crosses this center line, also determine a plane of reference.

On this consideration the proposition according to the invention is based for a method for the alignment in an optical manner of machine parts, as mentioned in the preamble of this specification, which method is characterized in that, as seen in the longitudinal direction of the machine beyond it, and as seen perpendicularly to the longitudinal direction of the machine to its side, a reflecting device, of which the effect corresponds with that of a reflecting surface, is placed in such a way, that each intersection of this reflecting surface with a horizontal plane is a straight line, which intersects or crosses the base perpendicularly, that thereafter the viewer of a theodolite is placed approximately in line with the center line of a machine part to be aligned or in line with a generating line (generatrix) on the surface of this part extending parallel to this center line, that next, by turning the view direction of the viewer around a vertical center line over approximately 90°, the viewer is pointed towards the reflecting device in such a way, that the point of intersection of the cross wires (lines) of the viewer coincides with a point of the vertical cross wire and preferably with the point of intersection of the cross wires of the reflection (image) of the viewer, that thereupon the view direction of the viewer is turned around a vertical axis over precisely 90°, that with the viewer adjusted in this way and rotatable in a vertical plane, the distance between a point of the center line at the front of the part and a vertical plane perpendicular to the base and the distance between a point of the center line at the back of the part and the same plane is determined, and that, in order to determine the deviation in the vertical plane, the distance from a point of the center line at the front of the machine part to a horizontal plane and the distance between a point of the center line at the back of the machine part to the same horizontal plane is determined by using a water level instrument.

The invention will further be explained by way of example only on the basis of the enclosed drawings.

Figure 1:
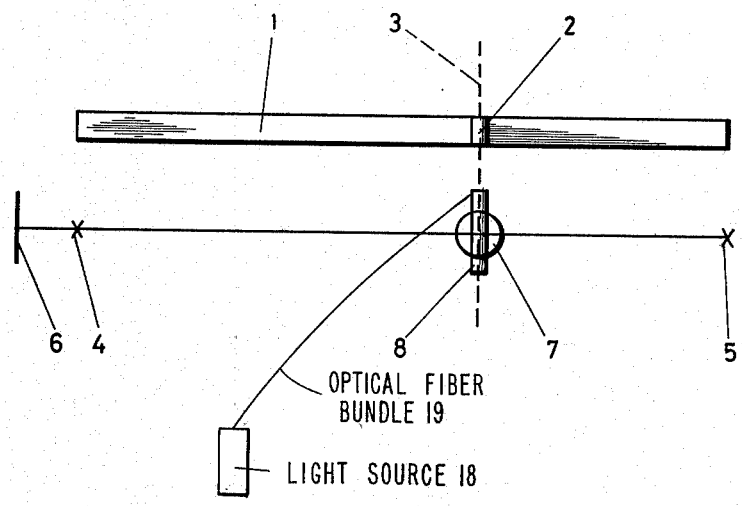
FIG. 1 is a diagrammatic plan of the hall in which the machine is positioned.

In FIG. 1 a machine is indicated by 1, and parts thereof, in this case rolls, have to be aligned. For convenience sake a single roll 2 is shown, of which the center line 3, indicated by a dotted line, has to be perpendicular to the center line of the machine 1. On the floor of the machine hall beyond the machine, two points, marked 4 and 5, determine a base line 4–5 which runs parallel to the center line of the machine. In a well known manner a reflecting device 6 is positioned at the lefthand side of the drawing, next to and beyond machine 1. The effect thereof corresponds with that of a reflecting surface that intersects a horizontal plane according to a straight line that crosses or intersects the base perpendicularly.

This reflecting device may be a flat mirror which is placed perpendicularly to the base and is firmly attached in or against one of the end walls of the machine hall, although under special circumstances a removable device may be preferred. However, it is worth while to maintain the fixed points 4 and 5 which determine the base, present at all times because in this case one has the opportunity to check once in a while whether the position of the reflecting device with respect to the base has moved or not, for instance by deformations in the machine hall. This checking of the position of the reflecting device with regard to the base need, however, not be done during maintenance operations, but may take place at any suitable moment provided that the space above and in line with the base is free.

The correct position of the viewer 8 of the theodolite 7 (for the sake of clearness this is indicated on too large a scale in the drawing) is now found by first putting this viewer in line with the center line 3 of a part 2 to be aligned, such as a roll, or in line with a generating line (generatrix) on the surface of this part 2, which runs parallel to the aforementioned center line. Next, the viewer 8 of the theodolite 7 is pointed towards the reflecting device 6. This may take place by turning the viewer around a vertical center line over an angle of 90° but it is preferred to make use of a device placed in front of the viewer which deflects the light rays over an angle of 90°, for instance a triangular prism. The use of such a device which deflects the light has the advantage, that the viewer need not be moved.

Then the viewer is turned in such a way that in the viewer the image of the point of intersection of the cross wires coincides with the reflected image of this intersection of the cross wires made by the reflecting device 6, or anyhow with a point of the image of the vertical wire of the cross wires. Since a rolling line can have a considerable length, for instance 200 meters, the cross wires of the viewer have to be lighted in such a way, that the image of same, which is apparently at a distance of 400 meters from the viewer, is still clearly perceptible. There are, it is true, light sources which are strong enough to light the cross wires in such a way that adjustment of the image thereof at the aforementioned distance is still possible, but these light sources have the disadvantages that they produce so much heat that the adjustment of the viewer is affected thereby.

According to the invention, a light source 18 positioned at some distance from the viewer is used together with a bundle 19 of optical fibres which leads the light of this light source to the cross wires. In this way, one achieves on the one hand that the heat of the strong light source can not affect the adjustment of the viewer, while on the other hand by applying a bundle of optical fibres one can nevertheless achieve that, in spite of the distance between the light source and the cross wires, still a considerable part of the light radiated by the light source is projected onto the cross wires.

It is also possible, in adjusting the viewer of the theodolite, to make use of a laser which emits a very narrow parallel light beam and which is placed over the viewer in such a way, that the laser beam and the center line of the viewer lay in the same vertical plane. The laser can also be positioned in such a way, that the laser beam for instance via a reflecting triangular prism or a semi-permeable reflector, is led through the viewer, so that the beam coincides with the center line of the viewer and leaves the viewer at the side of the object lens. The viewer should therewith be adjusted in such a way that the vertical cross wire extends through the center of the image of the laser beam or preferably that the point of intersection of the cross wires coincides with this center.

The choice of the wave length and the output of the emitted laser beam should be such that on the one hand a good visibility of the image of the beam is guaranteed, while on the other hand the risk of damaging the observer's eye is avoided.

With the known optical methods for the alignment of machine parts, the theodolite had to be always on the base 4–5. By application of the reflecting device 6 according to the invention, the theodolite can now be moved in a direction perpendicular to the base 4–5 over a distance which corresponds to the width of the reflecting device 6. If a plane mirror is applied as the reflecting device, the viewer 8 of the theodolite 7 can also be moved in a vertical direction during the adjustment with respect to the reflecting device 6 over a distance which corresponds to the height of the plane mirror. It may, however, offer advantage not to apply a plane mirror as the reflecting device, but a combination of two plane mirrors, which are perpendicular to each other and which intersect each other along a horizontal line, or a prism with two internally reflecting side faces being perpendicular to each other, which has the same result. By applying such a reflecting device which consists of two reflecting surfaces, one obtains the advantage that the height of the viewer 8 of the theodolite 7 in the adjustment with respect to the reflecting device, can vary much more than corresponds to the height of the reflecting device. This is so because an incident light ray on a plane perpendicular to the line of intersection of the two reflecting surfaces is always reflected by this device in a direction opposite to that of the incident ray. Thus, one obtains, by applying a reflecting device which comprises two reflecting surfaces which are perpendicular to each other, that the adjustment of the viewer is facilitated, and furthermore that a reflecting device of smaller dimensions is sufficient which considerably diminishes the risk of damage or moving of the device by shocks or accidental contact.

Figure 2:
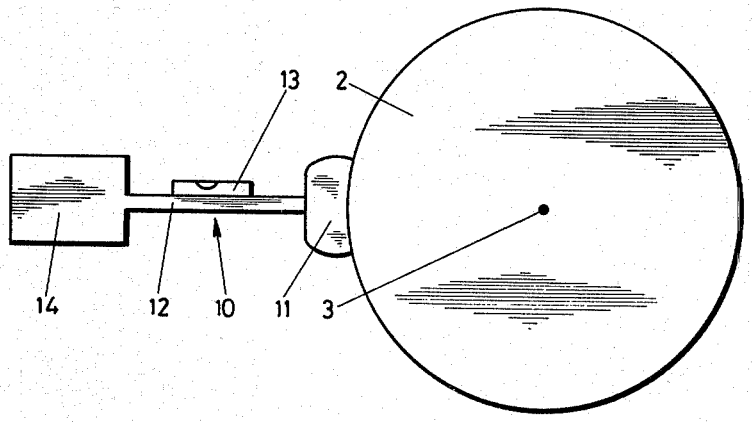
FIG. 2 shows a little tab put onto a roll.

After the viewer has been adjusted in such a way that the image of the point of intersection of the cross wires of the viewer coincides with the reflected image of this point of intersection, the viewing direction of the viewer is turned over 90° around a vertical axis. This can be performed by turning the viewer, but now it is preferred to remove the aforementioned device positioned in front of the viewer for deflecting the light rays over an angle of 90°. The theodolite is now adjusted in such a manner, that the viewer can turn exclusively in a vertical plane, after which the viewer is pointed towards the machine part to be aligned, or rather, towards a tab placed on this machine part. Such a tab is indicated in FIG. 2. In this Figure, circle 2 is the periphery of a roll to be aligned seen from aside, of which roll center line 3 is now seen as a dot. On this roll near one end a tab 10 is placed. This tab consists of a foot 11, which is suitable to be attached onto the surface of the roll. If the roll consists of ferro-magnetic material, it is advantageous to embody this foot as a permanent magnet. To this foot 11 is further attached a small bar 12, bearing a water level 13. The bar 12 has also a small vane 14 attached to that end thereof which is remote from foot 11.

After the tab 10 has been put onto roll 2 almost near one end of the surface thereof, the roll is rotated until the water level 13 indicates that the tab is in horizontal position. Next, with the viewer of the theodolite, which is adjusted in the manner described above, the vane 14 is observed; in particular a reference mark which is present on this vane is observed. Then the apparent distance between this reference mark and the vertical cross wire of the viewer is determined, preferably by making use of a plane-parallel plate which is present in front of the viewer and which can be rotated with a micrometer screw. By rotating this plane-parallel plate, the image of the vertical cross wire can be made to coincide with that of the reference mark on vane 14 and then one can read the apparent distance between them on the micrometer screw.

Thereafter vane 14 is again attached to roll 2, but not near the other end thereof, after which the above described procedure is repeated and again the apparent distance between the reference mark on vane 14 and the vertical cross wire of the viewer is determined. The difference between the two measured distances is a measure for the deviation in the horizontal plane between the actual position and the desired position of the center line of the machine part to be aligned, and as this deviation is determined numerically by the method described, the actual alignment of the machine part can be performed simply by readjustment of one or both bearings thereof or other supports.

Figure 3:
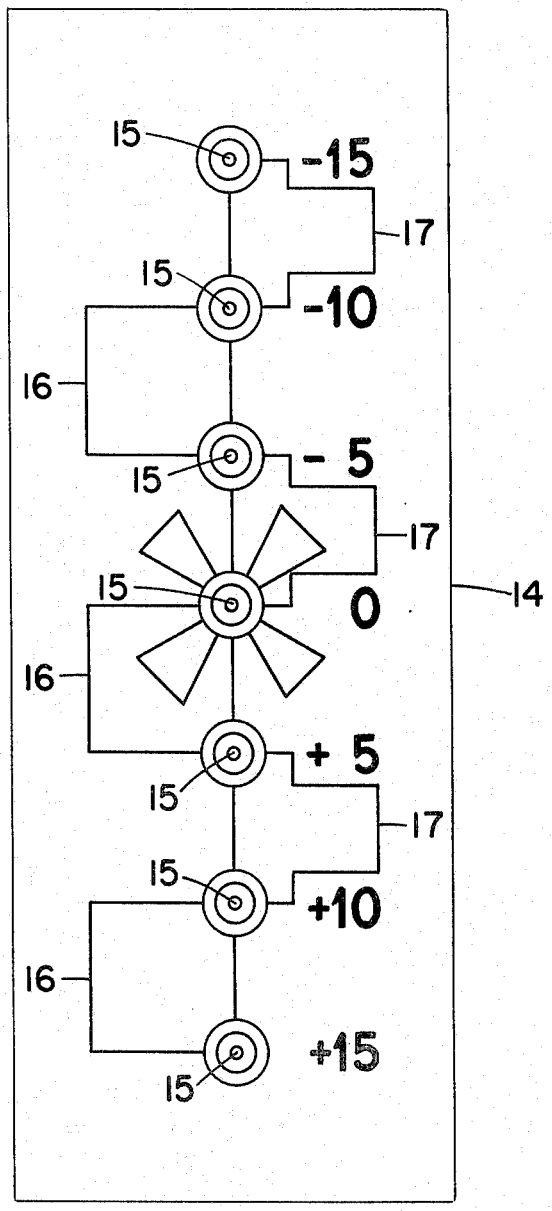
FIG. 3 is an enlarged drawing of the vane of the little tab in FIG. 2.

In FIG. 3 a small vane 14 of tab 10 is shown on an enlarged scale (5×). For convenience sake it was supposed above that there is only one reference mark on vane 14. In case the deviation of the machine part to be aligned, which has to be measured, is very large, it may occur that the apparent distance between the vertical cross wire of the viewer and the reference mark on the vane becomes too large to be measured with the help of the movable plane-parallel plate. For that reason not only one reference mark is put on the vane of FIG. 3, but a series of seven such reference marks 15 are positioned with respect to each other at a same, known distance (5 mm), which distance is within the measuring range of the plane-parallel plate.

Further, each reference mark is preferably marked by one or more concentric rings, the center of which coincides with the reference mark. In order to increase the visibility of these rings, at least one of these rings should be executed in a color which contrasts strongly with that of the rest of the vane.

Even though the reference mark can be found more easily due to the arrangement of the afore-mentioned concentric rings, this retrieving may still cause some difficulties. Therefore it is preferred to install a geometrical figure to at least one side, but preferably to two sides of the reference mark, tapering to become more narrow in the direction of the reference mark and also executed in a color which contrasts strongly with the rest of the vane.

In FIG. 3 a preferential embodiment is shown, in which two geometrical FIGS. 16, 17 are formed by squares and/or rectangles and set up in such a way, that they only have one common vertex, that the sides of these figures extending through this common vertex are in line with each other and that the reference mark coincides with said common vertex. Due to this arrangement it has in practice become much easier to find the reference mark.

In order to determine the deviation in the vertical plane between the actual position and the desired position of the machine parts to be aligned, it is possible to make use of the same vane as the one described before. However, roll 2 should then be rotated in such a way, that the vane 14 will be substantially in a vertical position and the water level 13 should in this case of course be positioned about perpendicularly to the bar 12 of the tab 10. To determine the deviation in the vertical plane, it is furthermore only necessary that a water level is used with a viewer which is adjusted precisely horizontally. It offers advantages therewith to make use of a water level, whereby the horizontal position of the viewer is automatically maintained.

I claim:

1. A method of optically aligning parts of a machine comprising the following steps:

a. providing two reference marks entirely outside the machine and at a distance from each other as long as possible, determining a base line usually running parallel to the longitudinal center line of the machine;

b. mounting, beyond the machine as seen in the longitudinal direction of the machine and to the side of the machine as seen perpendicularly to the longitudinal direction of the machine, a reflecting device with the aid of optical means, the effects of the reflecting device corresponding to that of one single reflecting surface and the mounting carried out in such a way that each intersection of this reflecting surface with a horizontal plane is a straight line intersecting or crossing the base line perpendicularly;

c. placing the viewer of a theodolite approximately in line with the center line of a machine part to be aligned, or in line with a generating line on the surface of said part and extending parallel to said machine part center line;

d. turning the view direction of the viewer over about 90° around a vertical axis and pointing the viewer towards the reflecting device in such a way that the point of intersection of the reticle of the viewer coincides with a point of the reflection image of the vertical line of said reticle;

e. turning the view direction of said viewer over exactly 90° about a vertical axis;

f. determining with the aid of the viewer adjusted in step (e) and rotatable in a vertical plane perpendicular to the base line, the distance between a point of the machine part center line or a generating line of said machine part at the front of this part and a vertical plane perpendicular to the base line and the distance between such a point at the back of this part and the same vertical plane;

g. determining in a numerical way the deviation of said machine part in a horizontal plane by calculating the differences between the two distances determimed in step (f);

h. determining with the aid of a water level and a theodolite the distance between a point of the center line or the generating line at the front of said machine part and a horizontal plane and the distance between such a point at the back of said machine part and the same horizontal plane;

i. determining in a numerical way the deviation of said machine part in a vertical plane by calculating the difference between the two distances determined in step (h);

j. correcting the position of said machine part in accordance with the numerical values of the deviations obtained in steps (g) and (i) respectively; and k. repeating steps (c–j) for the other machine parts to be aligned.

2. A method according to claim 1, in which the turning of the view direction of the viewer around a vertical axis and over 90°, as given in steps (d) and (e), is carried out by mounting in front of the viewer or taking away therefrom respectively a device which reflects light rays over an angle of 90°.

3. A method according to claim 1, comprising illuminating the reticle of the theodolite by means of a light source located at some distance from the viewer and of a bundle of optical fibres transmitting light from the light source to the reticle.

4. A method according to claim 1 in which the step of pointing the viewer towards the reflecting device includes positioning a narrow, parallel laser beam in the same vertical plane as the center line of the viewer and adjusting the viewer in such a way that the vertical line of the reticle extends through the center of the reflected image of the laser beam.

5. A method according to claim 1, in which the step (f) of determining includes placing a tab twice on the same generating line parallel to the center line on the surface of the machine part to be aligned, one time near the front end, and the other time near the back end of the machine part.

6. A method according to claim 1, in which step (h) includes automatically maintaining the horizontal position of a water level with a viewer.

7. A method according to claim 1, in which the reflecting device includes a plane reflecting surface and comprising mounting this plane reflecting surface perpendicularly to the base line.

8. A method according to claim 1, in which the reflecting device comprises two plane reflecting surfaces perpendicular to each other and comprising mounting this reflecting device in such a way that the intersection of the said two plane reflecting surfaces is a horizontal line perpendicularly crossing or intersecting the base line.

9. A method according to claim 1 in which the step of pointing the viewer towards the reflecting device includes positioning a narrow, parallel laser beam in a vertical plane coinciding with the center line of the viewer and adjusting the viewer in such a way that the center of the reticle coincides with the center of the reflected image.

* * * * *